US006190071B1

(12) United States Patent
Mochizuki et al.

(10) Patent No.: US 6,190,071 B1
(45) **Date of Patent: *Feb. 20, 2001**

(54) PRINTER AND CONTROL METHOD THEREFOR

(75) Inventors: Hidetake Mochizuki; Masahiko Yamada; Mitsuaki Teradaira, all of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/053,109

(22) Filed: Apr. 1, 1998

(30) Foreign Application Priority Data

Apr. 2, 1997 (JP) ..... 9-084239
May 8, 1997 (JP) ..... 9-118508

(51) Int. Cl.[7] ..... B41J 29/42

(52) U.S. Cl. ..... 400/708; 400/701

(58) Field of Search ..... 400/708, 708.1, 400/701, 702; 101/425; 347/22, 23, 33, 34

(56) References Cited

U.S. PATENT DOCUMENTS 5,061,095 * 10/1991 Asai et al. ..... 400/605
5,082,384 * 1/1992 Kakaguchi ..... 400/708
5,895,158 * 4/1999 Koyabu et al. ..... 400/605

FOREIGN PATENT DOCUMENTS 59-089189 5/1984 (JP) .
1-118868 * 5/1989 (JP) .
5-201583 8/1993 (JP) .
7-069488 3/1995 (JP) .

* cited by examiner

*Primary Examiner*—Ren Yan
(74) *Attorney, Agent, or Firm*—Nixon & Vanderhye P.C.

(57) ABSTRACT

A printer includes platen opening/closing means for increasing a gap between a platen and a print head when a printing medium is set to the printer, and cleaning means for cleaning a photo sensor device. The cleaning means removes paper dust, for example, accumulated to such an extent as to interrupt the optical path between the light emitting and receiving elements of the photo sensor device. The cleaning means is controlled by a control means contained in the printer. The control means drives the cleaning means when an output signal level of the photo sensor device is below a predetermined signal level after the printing medium is discharged out of the printer.

12 Claims, 8 Drawing Sheets

PRINTER AND CONTROL METHOD THEREFOR

BACKGROUND OF THE INVENTION

1. Field of the Invention

The present invention relates to a printer with a sensor for detecting a printing medium to be set in the printer, and more particularly to a cleaning mechanism for cleaning the sensor and a control method for the cleaning mechanism.

2. Description of the Related Art

For printing on forms, slips or the like, the printer has been widely used as the output terminal of POS systems, computer systems, personal computers and others. Some printers print each on a printing sheet, e.g., a roll paper, which is preset therein, and some printer include each a mechanism for printing on cut sheets, e.g., validation sheets, which are set one by one therein by the user.

The printer usually uses a photo sensor to check as to if a printing paper is set properly or at a correct position before the printing by the printer. The photo sensor includes the combination of a light emitting element, e.g., LED, and a light sensing element, e.g., a photo transistor. Those elements are arrayed while being spaced from each other. When a printing sheet is set in the printer, it interrupts a light beam emitted from the LED. By the interruption of the light beam, the photo sensor detects the setting of the printing paper in the printer.

The conventional printer suffers from the following problem. Various dusts such as paper dust or the like are accumulated on and around the sensor, and the accumulated dust interrupts the optical path of the light beam. As the accumulation of the dust progresses, the output signal of the photo sensor decreases. When the output level of the photo sensor goes below a predetermined signal level, the printer mistakenly recognizes this state as the setting of the printing paper, and erroneously operates.

Further, strict requirements are imposed on recent printers; high reliability, and some measures being taken for environmental issues such as long life, use of regenerated papers being acceptable and so on. Dusts generated therein are easily increased in those printers which are designed to satisfy such requirements.

SUMMARY OF THE INVENTION

Accordingly, an object of the present invention is to provide a printer which periodically removes various dusts such as paper dust, for example, accumulated on the sensor, to thereby ensure stable and reliable paper sensing by the printer.

Another object of the present invention is to provide a printer which prints out a state of the dust removal to thereby inform the user of the current dust removal state.

According to one aspect of the present invention, there is provided a printer (first printer) having a print head and a platen disposed opposite to the print head, in which the platen is opened and a printing medium is inserted into a gap created by opening the platen, and the platen is closed and in this state the printer prints on the printing medium, the printer comprising a detector for detecting the printing medium inserted in the printer; and a mechanism for removing foreign matters present within a detecting range of the detector while being linked with the opening and closing motions of the platen. When the printing medium detection is required, the opening and closing operations are performed. By linking the opening/closing operation of the platen with the operation of removing foreign matters from the detector, a detection error by the detector can be reliably eliminated.

The printer may further comprise: a plunger for opening and closing the platen; and a lever being coupled with the plunger, the lever turning with a forward movement and retractive movement of the plunger, the lever being coupled with the dust removing member, when the lever is turned, the dust removing member rectilinearly moving in a reciprocative manner (the printer thus constructed will be referred to as a second printer). The second printer facilitates the linking of the opening/closing operation with the foreign matter removing operation.

The first printer may further comprise: a comparing circuit for comparing an output signal level of the detector with first and second predetermined signal levels; and a control circuit for causing the dust removing mechanism to remove foreign matters when the output signal level of the detector is between the first and second predetermined signal levels; wherein when the output signal level of the detector is smaller than the first predetermined signal level, it is judged that the printing medium is inserted, and when the output signal level is larger than the second predetermined signal level, it is judged that the printing medium is not inserted (this printer will be a third printer). The second predetermined signal level is larger than the first predetermined signal level. The third printer determines if an object to be judged is a printing medium or foreign matter, and if it is foreign matter, the printer removes the foreign matter.

The first printer may be constructed such that the detector is a photo interrupter consisting of a light emitting element and a light receiving elements, the elements being disposed in opposition to each other.

The first printer may be constructed such that the dust removing member passes the adjacent area of the detector with the opening and closing movements of the platen (this printer will be referred to as a fifth printer). The fifth printer may be constructed such that the dust removing member passes under the detecting range of the detector.

The fifth printer may also be constructed such that the dust removing member moves away from the detector when the platen is opened, and moves toward the detector when the platen is closed or such that the dust removing member moves toward the detector when the platen is opened, and moves away from the detector when the platen is closed.

The first printer further comprises a visual presenting mechanism for visually presenting an operating state of the dust removing mechanism. In this case; it is preferable that the visual presenting mechanism includes a second printing medium and a printing mechanism for printing on the second printing medium. It is therefore possible to inform the user of the state of removing foreign matters.

According to another aspect of the present invention, there is provided a method for controlling a printer having a print head, a platen disposed opposite to the print head, and a detector for detecting a printing medium inserted into between the print head and the platen, the method comprising the steps of: opening the platen in preparation for the insertion of a printing medium; detecting the printing medium inserted in the printer; closing the platen after the printing medium is detected; printing on the printing medium after the platen is closed; and removing foreign matters present within a detecting range of the detector in association with the opening and the closing of the platen.

The control method further comprises: a step of comparing an output value produced in the detecting step with first and second predetermined values; and a control step for removing foreign matters when the output value is between the first and second predetermined values; wherein when the output value is smaller than the first predetermined value, it is judged that the printing medium is inserted, and when the output value is larger than the second predetermined value, it is judged that the printing medium is not inserted. In this case, the foreign matter removing operation comprises a predetermined number of opening and closing operations of the platen to thereby remove the foreign matters more positively.

The control method further comprises; a step of transporting the printing medium in the medium discharging direction; and a step of detecting the printing medium after the medium transporting step terminates; wherein the printing medium is detected the foreign matter removing step is executed. When the printing medium is transported in the medium discharging direction and it is detected out, although the printing medium does not exist within a detecting range the detected one can be considered as foreign-matter, and hence the operation of removing it is performed. In this case, if foreign matter removing step comprises a predetermined number of opening and closing operations of the platen, a reliable foreign matter removal is secured.

The control method further comprises: a step of visually presenting a start of removing foreign matters before the foreign matter removing step; and a step of detecting the recording medium again after the foreign matter removing step visually presenting and success or failure of removing foreign matters. It is therefore possible to inform the user of the state of removing foreign matters.

BRIEF DESCRIPTION OF THE DRAWINGS

In the accompanying drawings:

FIG. 8 is a flow chart showing an initial control carried out when a power switch is turned on.

DETAILED DESCRIPTION OF THE PREFERRED EMBODIMENTS

The printer of the present embodiment is of the dot impact type, and is capable of selectively printing two types of printing media, a cut sheet P, e.g., a validation paper, and a roll paper R. The printer includes a printer mechanism unit 1 constituted by a printing mechanism, a paper feeding mechanism, a ribbon transporting mechanism, and a detecting mechanism.

Figure 1:
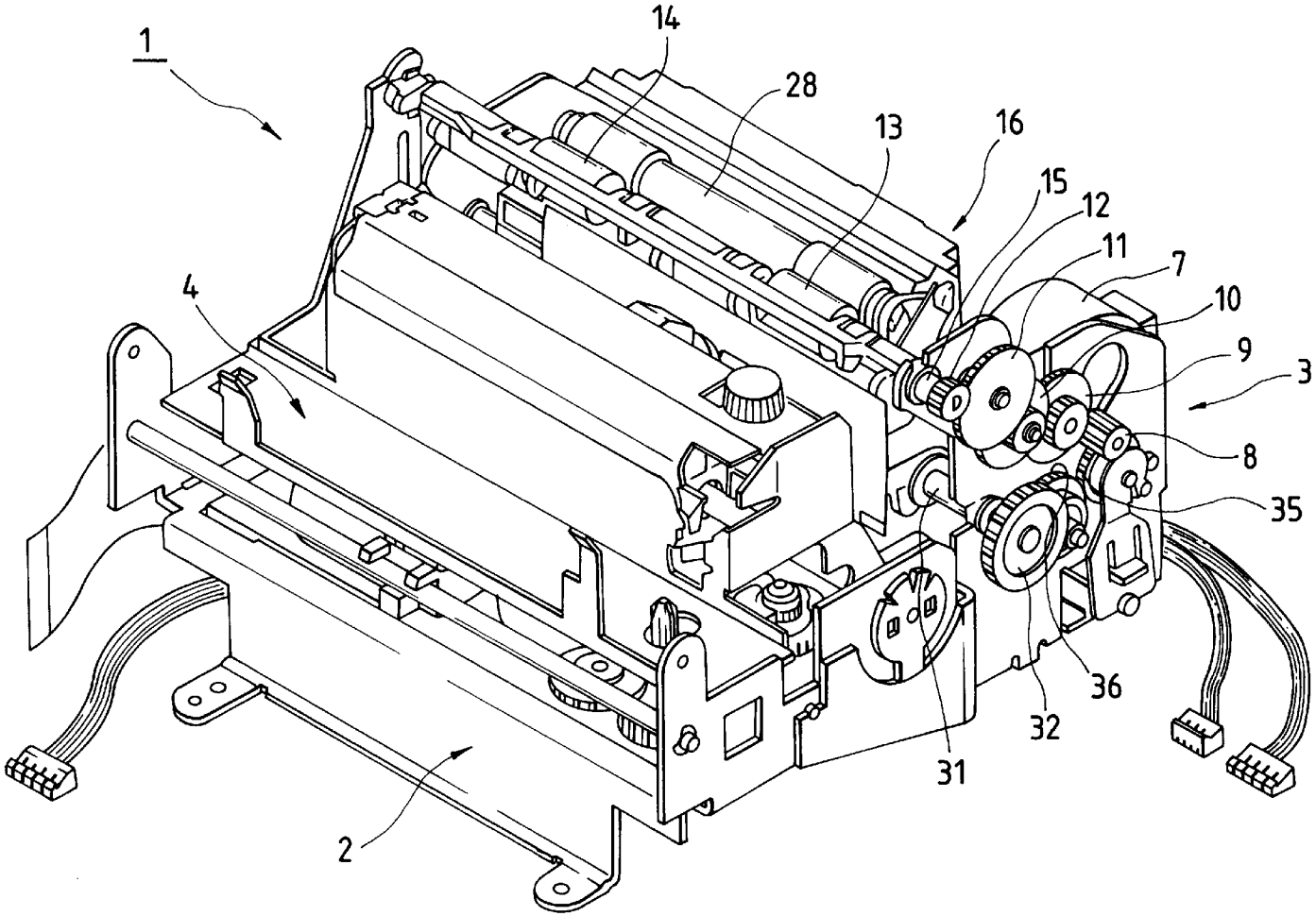
FIG. 1 is a perspective view showing an overall mechanism of a printer which is an embodiment of the present invention.
Figure 2:
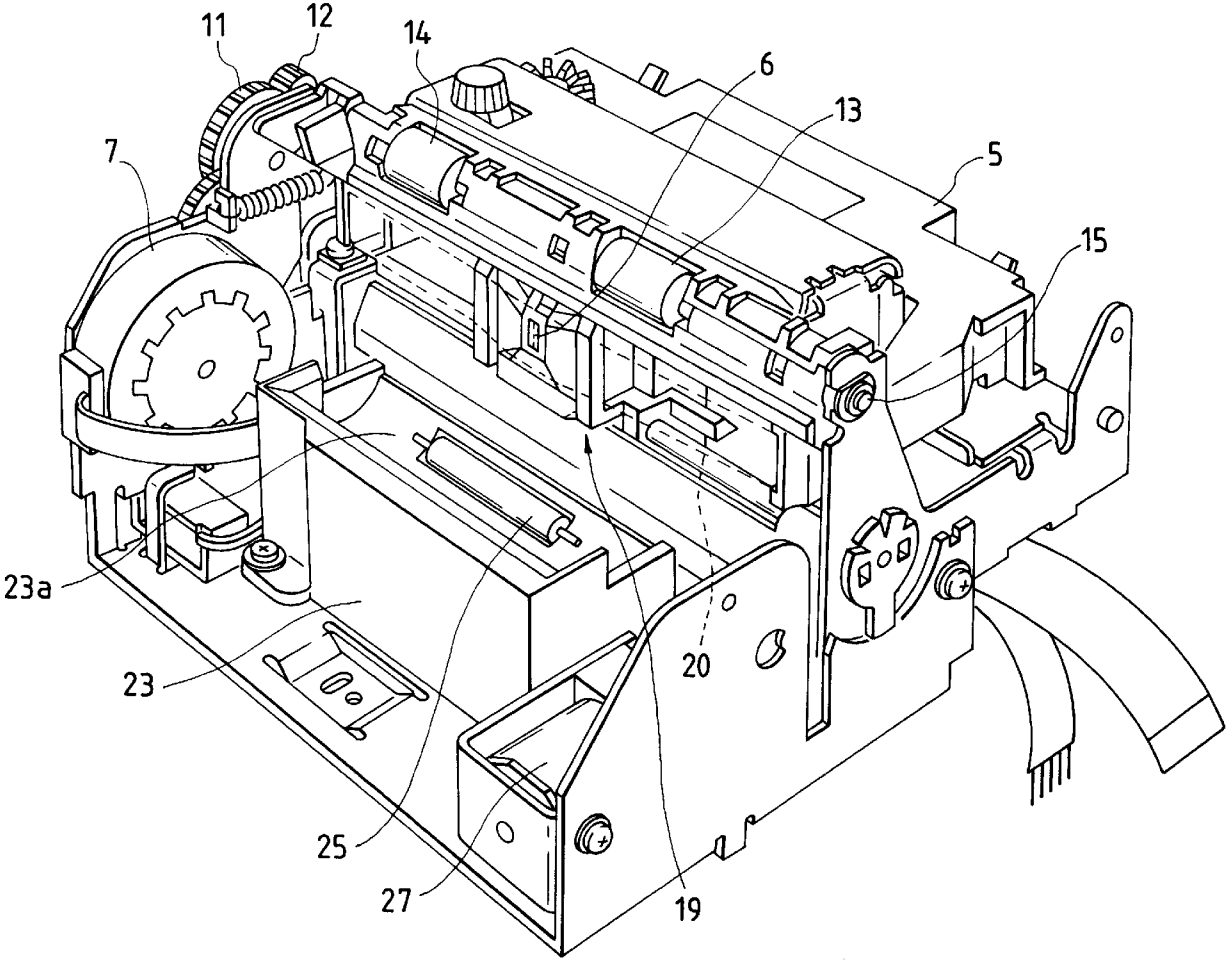
FIG. 2 is a perspective view showing the mechanism of the printer when a platen unit is removed, the mechanism being viewed from the rear side of the printer.

A main frame of the printer mechanism unit 1 includes a base frame 2 which is formed of, for example, soft steel plate by bent, a paper feeding frame 3 and a ribbon frame 4. A print head 6 and other parts are mounted on the main frame. In the front part of the printer mechanism unit 1, the ribbon frame 4 is mounted on the base frame 2. A ribbon cassette 5 is set to the ribbon frame 4 as shown in FIG. 2. The paper feeding frame 3 is provided in the rear part of the printer mechanism unit 1, and a roll paper R is disposed near the paper feeding frame 3. A paper feeding motor 7 is attached to one side of the paper feeding frame 3 in order to feed the roll paper R and the cut sheet P (FIG. 1). A rotation force of the paper feeding motor 7 is transmitted through a chain of gears 8, 9, 10, 11 and 12 to a roller shaft 15 on which paper feeding rollers 13 and 14 are mounted. Those rollers are located above the paper feeding frame 3 and near the ribbon frame 4. Those paper feeding rollers 13 and 14, made of such elastic material as rubber, are provided for transporting the cut sheet P.

Figure 4:
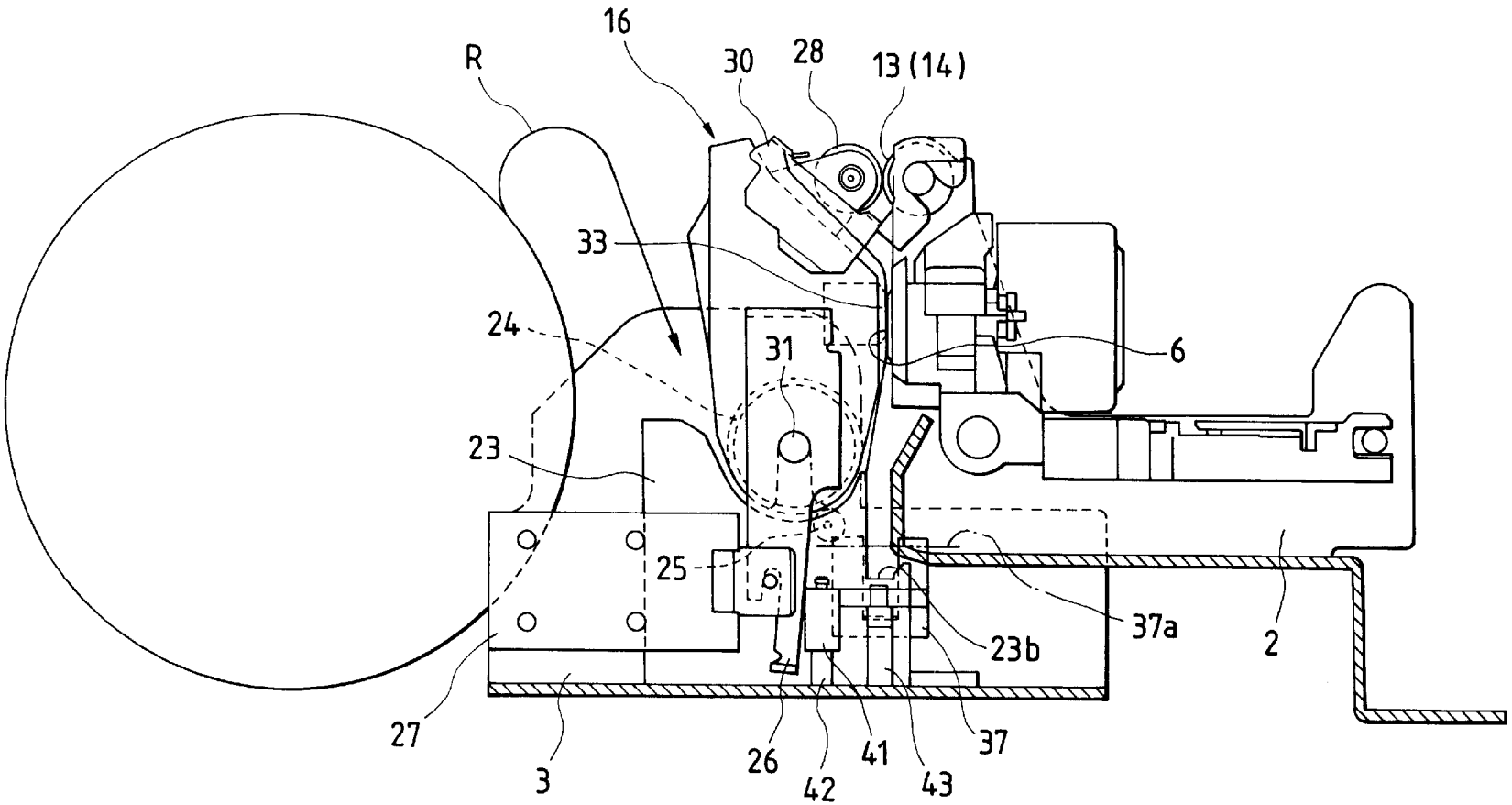
FIG. 4 is a side view schematically showing the printer when the platen unit is closed.

A rotation force of the paper feeding motor 7 is also transmitted through gears 32, 35 and 36 to a roller shaft 31 of paper feeding roller 24, which is mounted on the paper feeding frame 3 (see FIG. 4). The paper feeding roller 24 is provided for transporting the roll paper R.

A platen unit 16 is provided in the vicinity of the paper feeding rollers 13 and 14. The platen unit 16 includes at least a follower roller 28 to be in contact with the paper feeding rollers 13 and 14.

FIG. 2 shows an external appearance of the printer mechanism unit 1 of the printer when a platen unit is removed. The mechanism is viewed from the rear side of the printer.

The roller shaft 15 for the paper feeding rollers 13 and 14 is rotatably mounted on the upper part of the paper feeding frame 3.

A printing unit 19 is provided under the paper feeding rollers 13 and 14; the printing unit 19 is for printing on the roll paper R and cut sheet P; and it includes an impact-type print head 6. A transporting mechanism (not shown) moves the printing unit 19 in the longitudinal direction of the ink ribbon 20 pulled out of the ribbon cassette 5.

A receptacle 23 for introducing the roll paper R is mounted on the paper feeding frame 3. The receptacle 23 has a guide surface 23*a* shaped in conformity with the paper feeding roller 24. A follower roller 25 is provided above the guide surface 23*a* of the receptacle 23. The follower roller 25 is brought into contact with the paper feeding roller 24.

An actuator 27 as a plunger is mounted on one side of the paper feeding frame 3. The actuator 27 is provided for driving a lever member 26 (see FIG. 3) of the platen unit 16.

Figure 3:
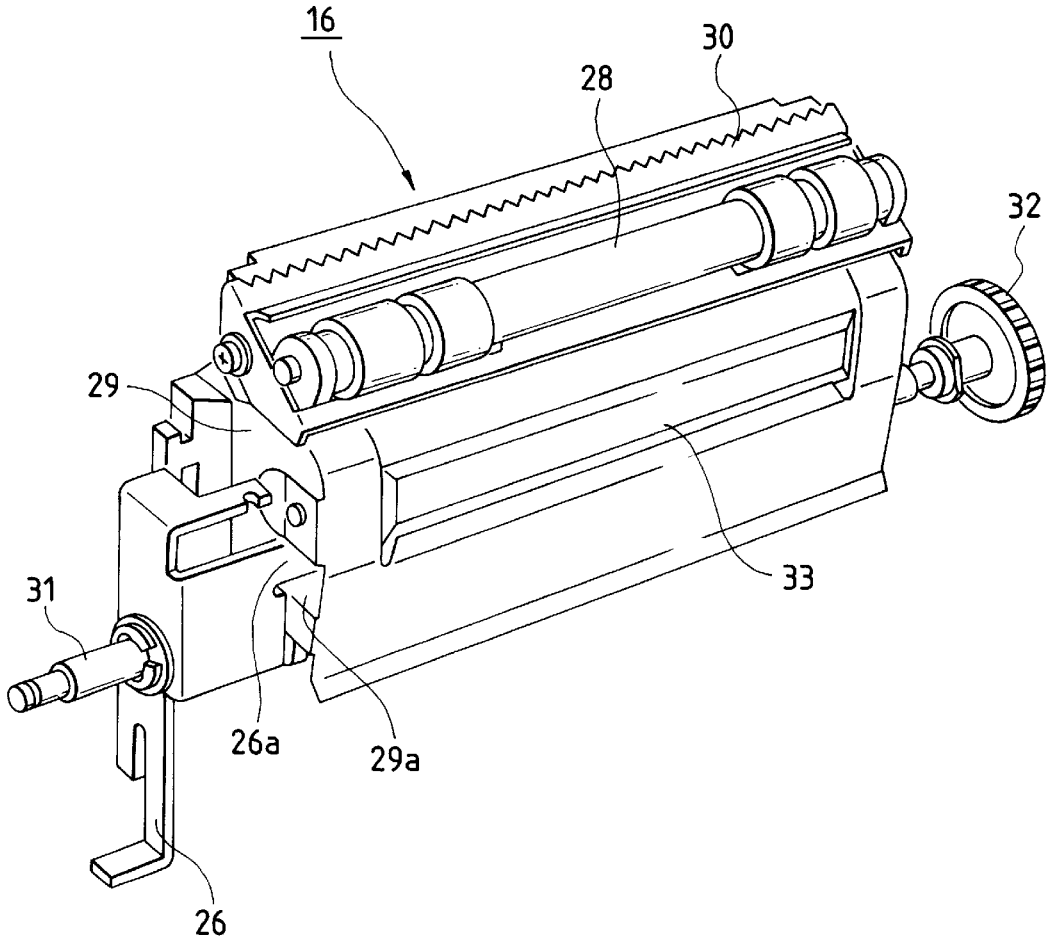
FIG. 3 is a perspective view showing the platen unit of the printer.

The platen unit 16 is constructed as shown in FIG. 3. The platen unit 16 includes a base member 29 made of resin, for example. A follower roller 28 is rotatably mounted on an upper part of the base member 29. The follower roller 28 is brought into contact with the paper feeding rollers 13 and 14. A manual cutter 30 is provided above the follower roller 28. The roll paper R is guided to the base member 29, and discharged through a gap or a paper path between the base member 29 and the manual cutter 30.

A platen 33 is provided while being confronted with the print head 6.

The paper feeding roller 24 is located under the base member 29 (FIG. 4); the roller 24 is for transporting the roll paper R; and the roller 24 is rotatable with a roller shaft 31. The gear 32 is fastened to one end of the roller shaft 31 in order to turn the paper feeding roller 24.

The lever member 26 is rotatablly attached to the other end of the roller shaft 31; the lever member 26 is coupled with the actuator 27 in a driven fashion; the lever member 26 has a protrusion 26*a*; and the protrusion 26*a* of the lever member 26 is coupled into a cut portion 29*a* of the base member 29.

The receptacle 23 includes a cut sheet guide surface 23*b*. A detector 37 is located on the cut sheet guide surface 23*b*. The cut sheet guide surface 23*b* serves as a contact part of a path for the cut sheet P. The detector 37 is provided for detecting the cut sheet P.

The inserted cut sheet P passes through a sensing position 37*a* of the detector 37 and reaches the cut sheet guide surface 23*b*. At this time, the detector 37 senses the cut sheet P and detects that the cut sheet P is present.

Figure 6:
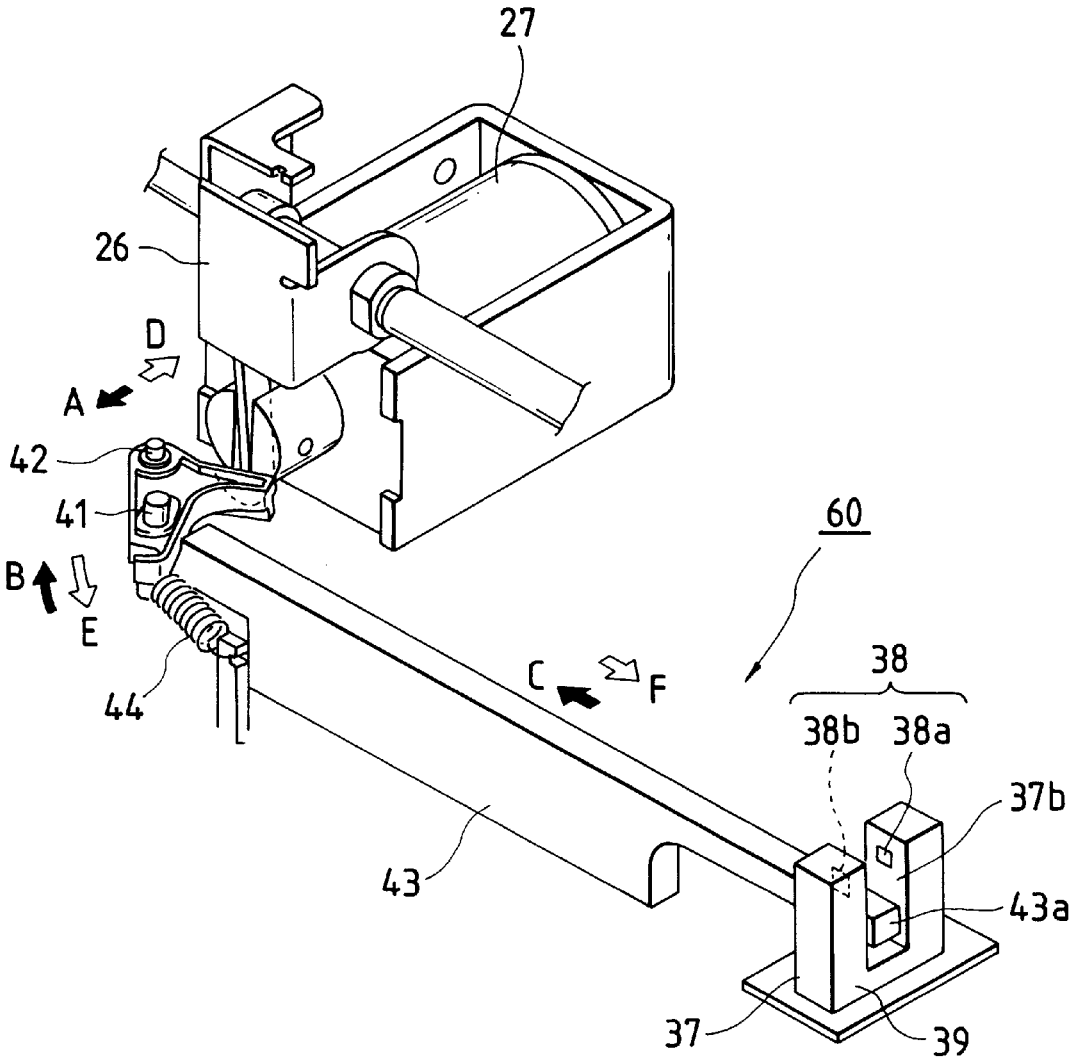
FIG. 6 is a perspective view showing a cleaning unit.

A construction of the detector 37 is illustrated in FIG. 6. The detector 37 is a well known photo interrupter. The detector 37 includes a LED 38*a* (light emitting element) and a photo transistor 38*b* (light receiving element). Each of those elements is disposed in each wing of a U-shaped support member 39 and opposing to each other. The LED 38*a* and the photo transistor 38*b* are attached to the distal ends of the wings of the U-shaped support member 39, respectively. The LED 38*a* and the photo transistor 38*b* constitute a sensing part 38 at the sensing position 37*a*. The support member 39 with those elements is fastened at the bottom thereof to the printer. Those wings and bottom of the support member 39 define an opening 37*b*. When the cut sheet P is set in the printer mechanism unit 1, the leading end of the cut sheet P is put within the opening 37*b* of the support member 39. The cut sheet P, when so put, interrupts a light beam emitted from the LED 38*a* and directed to the photo transistor 38*b*. As a result, the photo transistor produces an output signal of a reduced level. The detector 37 detects that the cut sheet P is present, on the reduction of the signal level.

A lever 41 is provided as shown in FIG. 6; it is coupled at one end with a spring 44 and at the other end with level member 26; and it is rotatable about a pivot 42. Under urging by the spring 44, the lever 41 is turned about the pivot 42 to be brought into engagement with a dust removing member 43. One end of the dust removing member 43 reaches right under the sensing part 38 of the detector 37 for detecting the cut sheet P.

The dust removing member 43 is guided onto the rear side of the cut sheet guide surface 23*b* of the receptacle 23, and it is slidably held thereon as shown in FIG. 4.

Next, a cleaning unit 60 is perspectively illustrated in FIG. 6. The cleaning unit 60 includes the dust removing member 43, lever 41, and the spring 44 for urging the lever 41 to turn to a given position. The dust removing member 43 is coupled with the actuator 27 with the lever 41 being interposed therebetween. Incidentally, the actuator 27 functions to turn the platen toward the print head (i.e., to close the platen) and away from the same (i.e., to open the platen). When the actuator 27 is driven to move in the direction A or D, the dust-removing member 43 is moved in the direction C or F that is perpendicular to the direction A or D. The lever 41 is horizontally swung about the pivot 42, which is fastened to the housing of the printer. Apart of the lever 41, which is located apart from the pivot 42, engages one end of the actuator 27. Another part of the lever 41, which is located apart from the pivot 42, engages one end of the dust removing member 43.

When the actuator 27 moves outward in the direction A, the lever 41 is turned about the pivot 42 clockwise to cause the dust removing member 43 retract in the direction C, and in turn, when the actuator 27 retracts in the direction D, the dust removing member 43 moves in the direction F. The spring 44 assists the lever 41 and the dust removing member 43 in returning to their home positions.

Figure 7A:
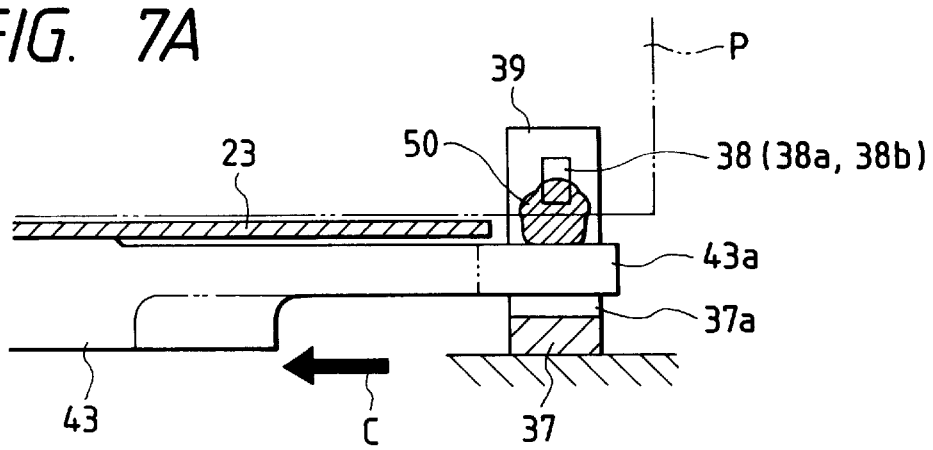
FIGS. 7A to 7C are explanatory diagrams for explaining the operation of the cleaning unit shown in FIG. 6.
Figure 7B:
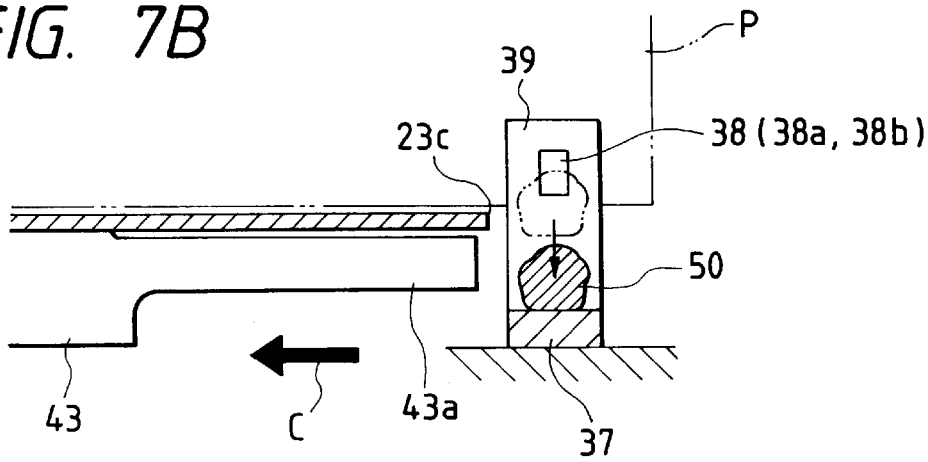
Figure 7C:
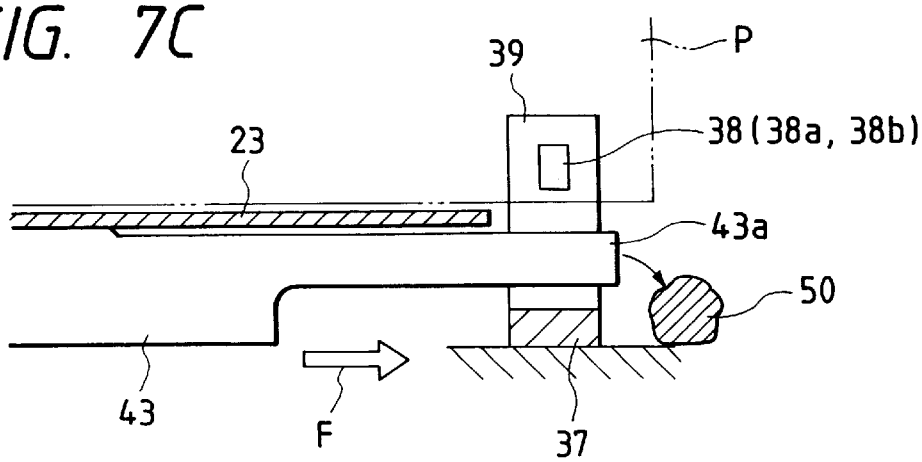

FIGS. 7A to 7C are diagrams useful in explaining the operation of the cleaning unit 60. As seen from the figure, the distal end 43*a* of the dust removing member 43 is at its initial position, viz., the position where the distal end 43*a* lies when the platen 33 is closed and being located in the lower part of the opening 37*b* of the detector 37. In other words, in a state that the platen 33 is closed, the distal end 43*a* of the dust removing member 43 is located lower than the optical path in the opening 37*b* of the detector 37 so as not to interrupt the optical path between the LED 38*a* and the photo transistor 38*b*. There is a chance of accumulating of paper dust on the upper surface of the distal end 43*a* of the dust removing member 43. Therefore, it is preferable to secure a sufficient clearance between the optical path and the upper surface of the distal end 43*a* in anticipation of the dust accumulation.

With the movement of the actuator 27 to move the platen 33 away from the print head 6, the dust removing member 43 is retracted in a direction C in FIG. 7A, and the distal end 43*a* of the dust removing member 43 moves out of the opening 37*b* of the detector 37. As recalled, the cut sheet guide surface 23*b* of the receptacle 23 is located above the dust removing member 43, and the leading edge of the cut sheet P is put on the cut sheet guide surface 23*b*. The dust removing member 43 moves along the cut sheet guide surface 23*b* of the receptacle 23. With the retractive movement of the dust removing member 43, paper dust 50 that is accumulated on the distal end 43*a* of the dust removing member 43 is pushed by the edge 23*c* of the cut sheet guide surface 23*b* and drops into the opening 37*b* of the detector 37 as shown in FIG. 7B. Then, the actuator 27 moves in the direction to move the platen 33 toward the print head 6 (to close the platen) and the actuator 27 returns its initial position. The distal end 43*a* of the dust removing member 43 pushes the paper dust out of the opening 37*b* as shown in FIG. 7C. In this way, the paper dust 50 is removed.

Next, the operation of the printer under discussion when it prints on the roll paper R and the cut sheet P will be described hereunder.

How it prints on the roll paper R will first be described. The actuator 27 is energized to drive the lever member 26. Through the motion of the lever member 26, the follower roller 28 of the platen unit 16 is brought into contact with the paper feeding rollers 13 and 14 (FIG. 4). when the printer does not print on the cut sheet P, the follower roller 28 remains pressed against the paper feeding rollers 13 and 14. The roll paper R passes through a paper path formed between the base member 29 of the platen unit 16 and the upper surface of the receptacle 23; it is subjected to the printing; and it is discharged through the gap between the base member 29 and the manual cutter 30.

At this time, the actuator 27 is held while being urged in the direction of an arrow D as shown in FIG. 6. The lever 41, urged by the spring 44, has been turned about the pivot 42 in the direction of an arrow E, and is in contact with the lever member 26. The dust removing member 43, which engages the lever 41, has been moved in the direction of an arrow F, and a distal end 43*a* of the dust removing member 43 is located while being protruded outward from the detector 37.

When the printer prints on the roll paper R, the detector 37 is not used. Paper dust and pieces, if produced, create no problem. There is no need of operating the dust removing member 43. Paper dust generated as the result of the printing on the roll paper R is accumulated on the paper path and the detector 37.

The printing on the cut sheet P will be described bellow.

Figure 5:
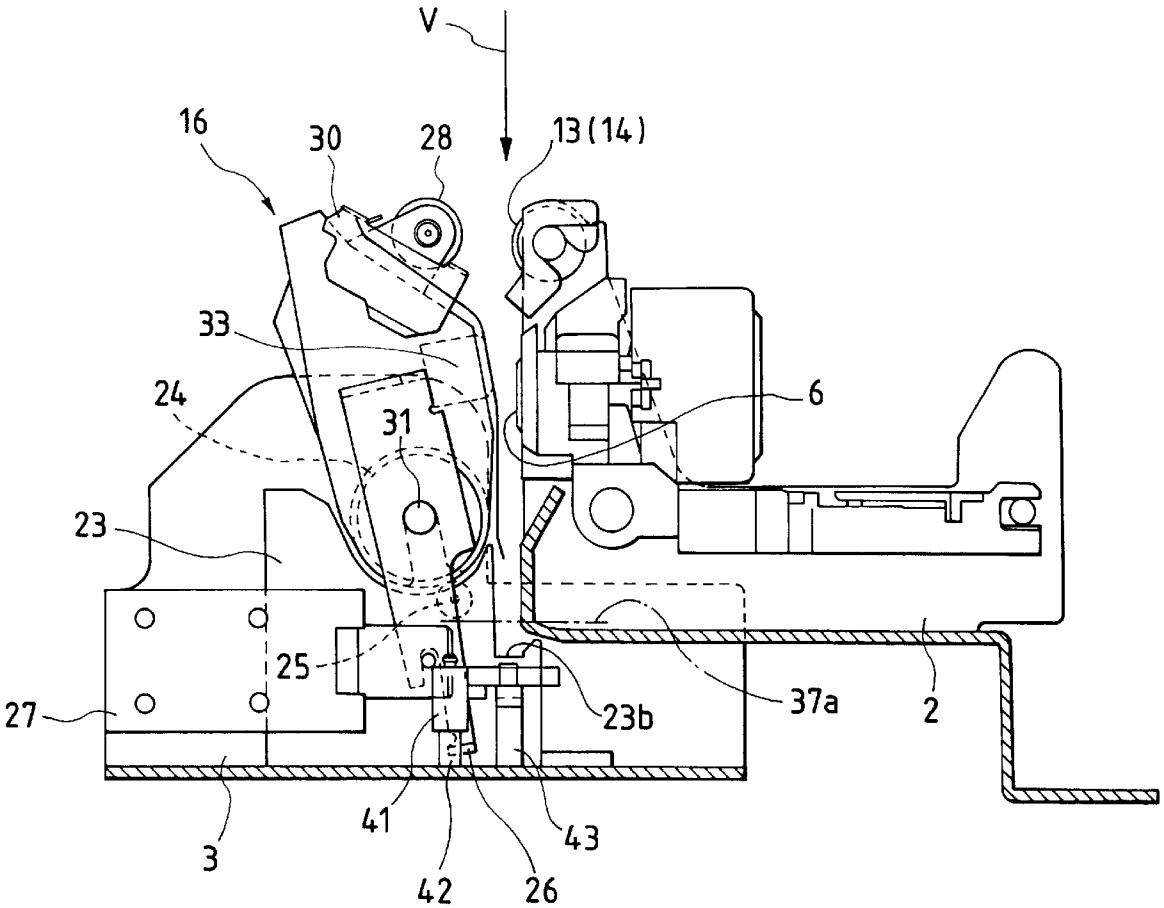
FIG. 5 is a side view schematically showing the printer when the platen unit is opened.

The actuator 27 is released as shown in the direction of the arrow A in FIG. 6. by the lever member 26, the platen unit 16 is put in an open state to form the paper path for the cut sheet P (FIG. 5). With the movement in the direction of the arrow A of the actuator 27, the lever 41 is turned about the pivot 42 in the direction of the arrow B. In turn, the dust removing member 43, which engages the lever 41, moves in the direction of the arrow C, and the distal end 43*a* of the dust removing member 43 is retracted from the detector 37 and held thereat.

A cut sheet P is put into the printer from above the paper feeding rollers 13 and 14 according to a direction of an arrow V in FIG. 5. In the present embodiment, the paper path for the cut sheet P is substantially vertical. This makes it easy to set the cut sheet P in the printer. The cut sheet P, after inserted, reaches the cut sheet guide surface 23*b* of the receptacle 23, and interrupts the sensing part 38 of the detector 37.

When inserted, the leading end of the cut sheet P sometimes moves paper dust present in the paper path to the sensing part 38 of the detector 37. When the distal end 43*a* of the dust removing member 43 is moved in the direction C and retracted from the opening 37*b* of the detector 37, the paper dust moved by the cut sheet P drops right under the sensing part 38.

When the detector 37 detects that the paper is present, the actuator 27 is driven to move in the direction of the arrow D in FIG. 6. In turn, the lever member 26 brings the follower roller 28 of the platen unit 16 into contact with the paper feeding rollers 13 and 14, while the cut sheet P is nipped between the follower roller 28 and the paper feeding rollers 13 and 14 so as to return to the state shown in FIG. 4. The actuator 27 is moved in the direction D in FIG. 6. The lever 41 is turned about the pivot 42 in the direction of an arrow E. The dust removing member 43, which engages the lever 41, is moved in the direction of the arrow F shown in FIGS. 6 and 7C. The distal end 43*a* of the dust removing member 43 passes through the detector 37 to purge the paper dust, which is accumulated right under the sensing part 38 of the detector 37, out of the detector 37.

The paper feeding motor 7 (FIG. 1) is driven to rotate. A rotation force of the motor is transmitted through the chain of gears 8 to 12 to the roller shaft 15 of the paper feeding rollers 13 and 14. The paper feeding rollers 13 and 14 are turned to transport the cut sheet P. Characters, for example, are printed on the moving cut sheet P by the print head 6 in cooperation of the platen 33.

In the present embodiment, the platen 33 is moved to and away from the print head 6. If required, the print head 6 may be moved to and from the platen 33. Also in this case, it is preferable that a validation transporting section, which includes the paper feeding rollers 13 and 14 and the follower roller 28, is moved together with the movement of the print head 6.

In the embodiment, the printer mechanism unit 1 is of the dot impact type, but may be of the thermal type, the ink jet type, or other type well known to the art.

Thus, with the movement for opening the platen 33, the dust removing member 43 retracts from the opening 37*b* of the detector 37, and with the movement for closing the platen 33, the dust removing member 43 pushes the paper dust out of the opening 37*b*. This feature is more effective for the following reason. Foreign matters, e.g., paper dust, are often nipped between the platen 33 and the print head 6 when the platen 33 is closed. The foreign matters will drops into the opening 37*b* of the detector 37 when the platen 33 is opened, viz. it is moved apart from the print head 6. Such foreign matters are purged out of the opening 37*b* when the platen 33 is closed.

Alternatively, the foreign matter removal mechanism may be constructed as follows: with the opening movement of the platen 33, the dust removing member 43 advances into the opening 37*b* of the detector 37 to push foreign matters out of the opening 37*b*; and with the closing movement of the platen 33, the dust removing member 43 retracts from the opening 37*b*. The alternative produces the following advantage. During the printing operation performed in a state that the platen 33 is closed, the dust removing member 43 is out of the opening 37*b* of the detector 37. Therefore, the space within the opening 37*b* of the detector 37 is increased by the amount of the space occupied by the distal end 43*a* of the dust removing member 43. In the other words, a large space is secured for receiving the foreign matters that have fallen from the above part of the printer mechanism unit 1 and accumulated therein. The result is that a mistaken detection by the photo transistor does not occur until the large space is filled with the foreign matters.

In the above-mentioned embodiment, the foreign matter removal operation, that is, the cleaning operation, is linked with the opening/closing operation of the platen 33. The reason for this is as follows. The opening/closing operation of the platen 33 is inevitably performed in the event needing the detection of the validation paper by the detector 37. Therefore, the linking of those operations remarkably reduces the mistaken detection by the photo transistor. In a specific example, the photo transistor must continue the sensing as to whether the paper is inserted or not while the printer waits for the insertion of the validation paper. The opening operation of the platen 33 is inevitably performed before the printer is put in this waiting state. An alternative of this is possible, as a matter of course.

Figure 8:
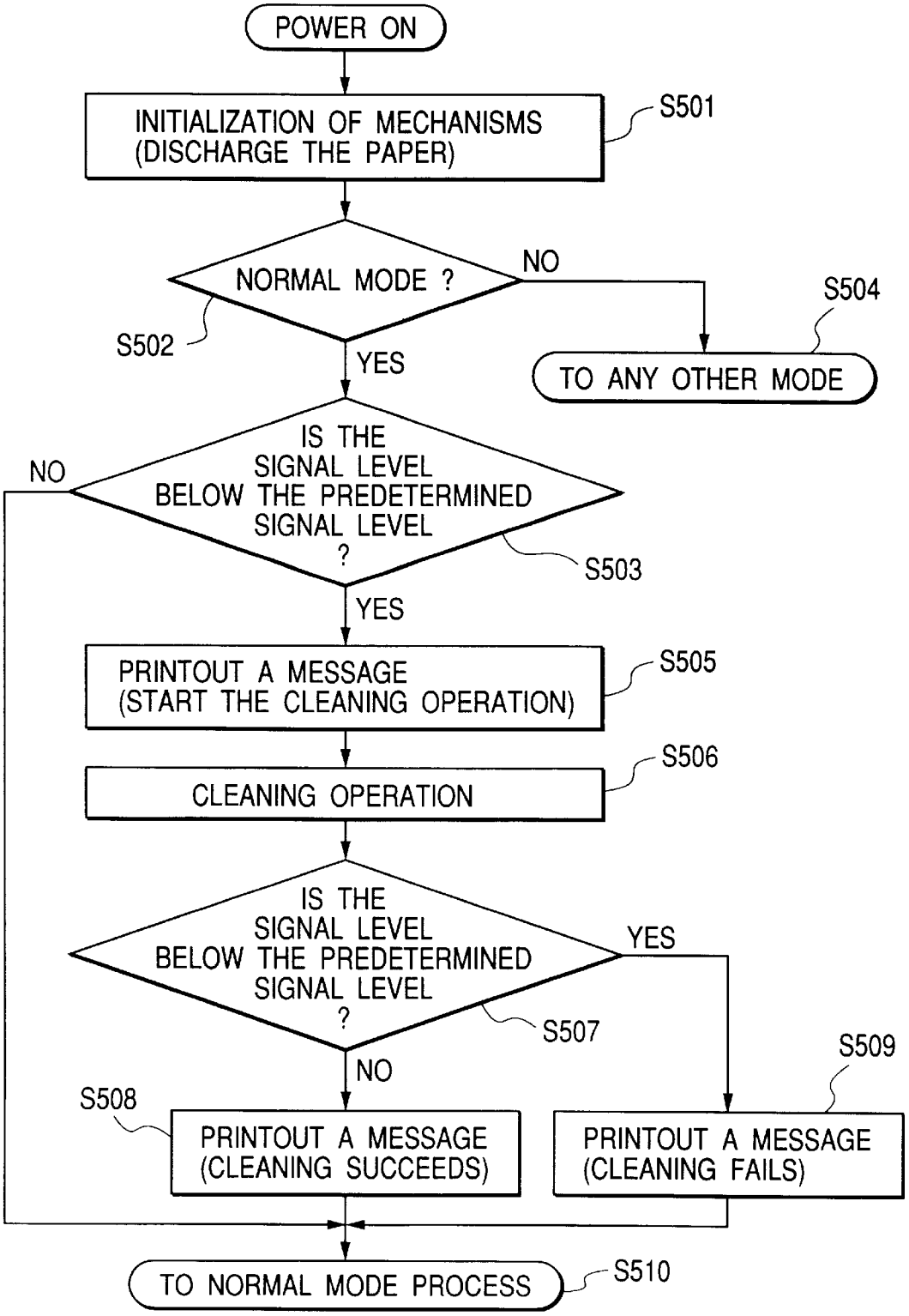

FIG. 8 is a flow chart showing an initial control carried out when a power switch of the printer is turned on. The printer of the present embodiment is arranged such that when the power switch of the printer is turned on, the cleaning unit 60 cleans the detector 37, and a cleaning state is printed out.

Upon power on, the mechanisms are initialized, for example, the print head 6 is moved to the home position (step S501). At this time, the paper feeding rollers 13, 14 are driven to discharge the paper out of the printer mechanism unit 1. There is a case where a sheet is set in the printer mechanism unit 1 before power on. In this case, the operation of the printer is instable. This instable state must be removed. Accordingly, if a cut sheet has been set in the printer mechanism unit 1, it is discharged by the initializing operation.

An operation mode of the printer is judged (step S502). If the printer is in a normal mode, the detector 37 detects if a printing sheet is present (step S503). If the operation mode is any other mode (e.g., self-test mode) than the normal mode, the paper detection is not carried out and the process for that mode is carried out (step S504). The mode selection by the printer is not essential to the present invention, and the cleaning process of the invention may be carried out independently of the operation modes of the printer.

If the paper detection result (step S503) shows that the output signal level of the detector 37 is above a predetermined signal level, viz., a sufficient amount of light is transmitted from the LED 38*a* to the photo transistor 38*b*, it is judged that there is no need of cleaning the detector 37, and the process for the normal mode is carried out (step S510). If the output signal level is below the predetermined signal level, it is judged that paper dust 50 is present on the optical path in the detector 37, and the following operations are performed. The printer prints out a message that a cleaning operation by the cleaning unit 60 starts (step S505). The message is printed out on a roll paper R preset in the printer. The cleaning unit 60 cleans the detector 37 (step S506). The cleaning unit 60 is driven by energizing the actuator 27 as a platen opening/closing mechanism. In the cleaning operation, it is preferable to control the number of operations of driving the actuator 27 so as to reliably remove the paper dust 50. In a test conducted, the solenoid of the actuator was controlled so as to repeat the cleaning operations five times. The result was that the paper dust 50 was completely removed.

Following the cleaning operation by the cleaning unit 60, the output signal level of the detector 37 is detected again (step S507). If the level detection result shows that the output signal level is higher than the predetermined one, it is judged that the paper dust 50 in the detector 37 is removed, and a message that the cleaning succeeded is printed on the roll paper R (e.g., "Cleaning succeeds") (step S508). If the output signal level is still below the predetermined one, a message describing that the cleaning operation fails (e.g., "Cleaning fails, and call the service person.") is printed out on the roll paper R (step S509). After it is printed, the control shifts to a normal mode process (step S510).

The reference signal level, or the predetermined signal level, may be set at a signal level higher than that produced by the detector 37 when the printing medium is present. Therefore, the presence of the paper dust 50 is detected before a mistaken detection by the photo transistor takes place. In this respect, the device reliability is improved. That is, a difference between the reference signal level used for detecting the paper dust 50 and the reference signal level for detecting the presence or absence of the printing medium provides a noise margin in the paper detection. The control for the cleaning unit 60 may readily be realized, by those skilled in the art, by utilization of a microprocessor mounted on the printer and a control program executed by the microprocessor.

While a specific embodiment of the present invention has been described while referring to the accompanying drawings, it should be understood that the invention is not limited to the described one but may variously be modified, altered and changed within the true spirits and the scope of the invention. While in the embodiment, a cleaning state is printed out, it may be displayed on a display screen if the printer is equipped with a display device, or neither the printing nor the displaying of the cleaning state may be performed. In the printer discussed in the embodiment, a single printing section is used for both the cut form and the roll paper for their printing. The invention is applicable to the printer uses printing sections respectively provided for the cut sheet and the roll paper, as a matter of course.

The cleaning unit discussed in the embodiment is merely one specific form of the cleaning mechanism, and hence the cleaning mechanism may take any of other various forms. For example, the cleaning mechanism may be constructed by a brushing member moving in the opening 37*b* of the support member 37. or the cleaning mechanism may be constructed so as to blow paper dust out of the opening of the detector in accordance with opening/closing motion of the cut sheet inlet. The detector 37 of the embodiment is a photo interrupter comprising an LED and a photo transistor, both being oppositely disposed. It may be replaced by a known photo reflector or dust sensitive paper detectors. The construction of the photo reflector is that a LED and a photo transistor are adjacently disposed in a jointed fashion, and the LED emits a light beam to an object and the photo transistor receives the light beam reflected by the object.

The embodiment is arranged such that upon power on, the cleaning unit is driven to start its operation. The cleaning unit may be operated at a given timing after the cut sheet P is discharged out of the printer. A control method for driving the cleaning unit other than that shown in FIG. 8 may be used for the present invention, as a matter of course. For example, the step S506 of the flow chart shown in FIG. 8 may be modified as follows: The output signal level of the detector 37 is detected every time the cleaning operation is executed, and the signal level detecting operation is repeated till the detected signal level exceeds a predetermined signal level. After the output signal level exceeds the predetermined one, the cleaning operation is repeated plural times, and the necessary process is executed.

As seen from the foregoing description, the printer of the invention periodically removes paper dust, for example, accumulated on the optical path of the photo sensor. Therefore, a stable paper detection by the photo sensor is realized. The drive source for opening and closing the platen is used for driving the cleaning mechanism. In other words, there is no need of using the drive source exclusively provided for driving the cleaning mechanism. The result is a simplification of the printer structure.

The dust removing mechanism is linked in operation with paper transport opening/closing mechanism for opening and closing the cut sheet transport path. With this structural feature, paper dust, for example, is removed from the opening of the detector before an output signal of the detector is detected. This leads to improvement of the detection performance.

When foreign materials, e.g., paper pieces, in addition to paper dust, enter the detector in a state that no cut sheet is present (for example, after the cut sheet is discharged as the result of the initializing operation), those materials are removed by repeating the motion of the dust removing mechanism several times.

The printer prints out a state of cleaning on a printing medium, and the cleaning state is visually presented to the user. Accordingly, the user can take a proper action while seeing the printed cleaning state.

What is claimed is:

1. A printer comprising:

a print head;

a platen disposed opposed to said print head, wherein said platen is opened and a first printing medium is inserted into a gap created between said print head and said platen by opening said platen, and said platen is closed and in this state said printer prints on said first printing medium;

a detector for detecting said first printing medium inserted, said detector having a detecting range; and means for removing foreign matters present within said detecting range of said detector, said removing means being linked with opening and closing motions of said platen and being urged thereby to translate along a path within said printer such that incursion of said removing means into said detecting range of said detector is prevented.

2. The printer according to claim 1, further comprising:

a plunger for opening and closing said platen; and a lever being coupled with said plunger, said lever turning with a forward movement and retractive movement of said plunger, wherein said lever is coupled with said removing means, when said lever is turned, said removing means moving in a reciprocative manner.

3. The printer according to claim 1, wherein said detector comprises a light emitting element and a light receiving element, said elements being disposed in opposition to each other.

4. The printer according to claim 1, wherein said removing means passes adjacent the detecting range of said detector in accordance with the opening and closing movements of said platen.

5. The printer according to claim 4, wherein said removing means passes under the detecting range of said detector.

6. The printer according to claim 4, wherein said removing means moves away from said detector when said platen is opened, and moves toward said detector when said platen is closed.

7. The printer according to claim 4, wherein said removing means moves toward said detector when said platen is opened, and moves away from said detector when said platen is closed.

8. The printer according to claim 1, further comprising representing means for representing an operating state of said removing means.

9. The printer according to claim 8, wherein said representing means includes a second printing medium.

10. The printer according to claim 8, said print head having a first print section for printing on said first printing medium, and said representing means including a second printing medium and a second print section on said print head for printing on said second printing medium.

11. A printer comprising:

a print head;

a platen disposed opposed to said print head, wherein said platen is opened and a printing medium is inserted into a gap created between said print head and said platen by opening said platen, and said platen is closed and in this state said printer prints on said printing medium;

a detector for detecting said printing medium inserted;

means for removing foreign matters present within a detecting range of said detector while being linked with opening and closing motions of said platen;

a comparing circuit for comparing an output signal level of said detector with first and second predetermined signal levels; and a control circuit for causing said removing means to remove foreign matters when the output signal level of said detector is between said first and second predetermined signal levels, wherein, when the output signal level of said detector is smaller than said first predetermined signal level, it is judged that said printing medium is inserted, and when the output signal level of said detector is larger than said second predetermined signal level, which is larger than said first predetermined signal level, it is judged that said printing medium is not inserted.

12. A printer comprising:

a print head;

a platen disposed opposed to said print head adapted to be moved between an open position, with regard to which a gap, adapted to receive a printing medium, interposes said printhead and said platen, and a closed position, with regard to which said gap is substantially reduced to allow said print head to print on said received printing medium against said platen;

a printing medium path including said gap;

a print medium detector along said path; and a foreign matter removing member located adjacent said detector, said foreign matter removing member having a motion linked to said opening and closing motion of said platen, and being urged thereby to translate along a path within said printer such that incursion of said member into said printing medium path is prevented.

* * * * *